US007980253B2

(12) United States Patent
Dumler

(10) Patent No.: US 7,980,253 B2
(45) Date of Patent: Jul. 19, 2011

(54) APPLICATOR, IN PARTICULAR FOR MASCARA

(75) Inventor: Norbert Dumler, Ansbach (DE)

(73) Assignee: Geka Brush GmbH, Bechhofen (DE)

( * ) Notice: Subject to any disclaimer, the term of this patent is extended or adjusted under 35 U.S.C. 154(b) by 371 days.

(21) Appl. No.: 11/501,103

(22) Filed: Aug. 9, 2006

(65) Prior Publication Data

US 2007/0034224 A1 Feb. 15, 2007

(30) Foreign Application Priority Data

Aug. 11, 2005 (EP) ..... 05017442

(51) Int. Cl.
*A45D 40/26* (2006.01)

(52) U.S. Cl. ..... 132/218

(58) Field of Classification Search ..... 132/216, 132/218, 317, 320; 401/126, 128
See application file for complete search history.

(56) References Cited

U.S. PATENT DOCUMENTS

| | | | | |
|---|---|---|---|---|
| 4,527,575 | A * | 7/1985 | Vasas | 132/218 |
| 4,540,007 | A * | 9/1985 | Carracoy | 132/218 |
| 4,545,393 | A * | 10/1985 | Gueret et al. | 132/218 |
| 6,067,997 | A * | 5/2000 | Gueret | 132/218 |
| 2002/0059942 | A1 * | 5/2002 | Neuner et al. | 132/218 |
| 2005/0058496 | A1 * | 3/2005 | De La Poterie et al. | 401/1 |
| 2006/0042647 | A1 * | 3/2006 | Vogel | 132/218 |

FOREIGN PATENT DOCUMENTS

| | | | |
|---|---|---|---|
| CH | 372 802 | | 10/1963 |
| DE | 25 33 481 | A1 | 1/1977 |
| EP | 0 432 384 | A | 6/1991 |
| WO | WO 98/43511 | A | 10/1998 |

* cited by examiner

*Primary Examiner* — Rachel R Steitz
(74) *Attorney, Agent, or Firm* — Browdy and Neimark, PLLC

(57) ABSTRACT

In an applicator for mascara, hair colorants or similar cosmetic products including a main body of a relatively hard material, such as metal or hard plastic, the main body being connectable to a rod and having a plurality of circumferential grooves, provision is made, in order to improve the combing action and transfer properties, for the grooves to extend parallel to each other and substantially perpendicular to the longitudinal axis.

10 Claims, 2 Drawing Sheets

APPLICATOR, IN PARTICULAR FOR MASCARA

BACKGROUND OF THE INVENTION

1. Field of the Invention

The invention relates to an applicator for mascara, hair colorants or similar cosmetic products comprising a main body of a relatively hard material, such as metal or hard plastic, said main body being connectable to a rod and having a plurality of circumferential grooves.

2. Background Art

An applicator according to the preamble is known from CH 372 802. The known applicator has a metallic main body on whose surface relatively fat, helical grooves are provided. Applicators of this type are also known from EP 0 432 384, WO 98/43511, and DE 25 33 481 A1.

An applicator of this type has proven to be effective per se, but it has the shortcoming that, due to their pitch which is caused by the helical configuration, the helical grooves of relatively shallow depth do not exert any combing action onto the eyelashes, or at least not a sufficient combing action, and increasing the volume of the eyelashes, on the other hand, is nearly impossible because of the shallow depth.

SUMMARY OF THE INVENTION

With this as the starting point, the invention has as its object to improve an applicator of the type in question in such a way that, while preserving the fundamental advantages of this applicator type, the combing properties and volumizing action during application are improved.

This object is met according to the invention in such a way that the grooves extend parallel to each other and substantially perpendicular to the longitudinal axis of the main body, the depth of the grooves being 0.4 mm to 2.1 mm, especially approximately 0.8 mm.

As a result of the grooves being arranged parallel to each other, a noticeably improved combing action and uniform application is achieved as compared to a helical arrangement according to the prior art. As a result of these relatively deep grooves, as compared to the prior art, improved transfer properties are achieved for the liquid mascara, as well as an enhanced combing action.

Studies have shown in particular that, in order to attain an effective combing action, the region of the eyelash base on the eyelid is of special importance in such a way that a large part of the combing action takes place in the outermost peripheral region of the applicator. It has been shown in this context that the eyelashes, as a rule, do not exit on the eyelid properly aligned and in one row, but that they aye formed largely randomly distributed in multiple rows above each other. The inventive design addresses these anatomical facts in an optimal manner. To attain these advantages, it is accordingly worthwhile to accept the higher expense of production that is associated with the inventive implementation of grooves parallel to each other and perpendicular to the longitudinal axis, as opposed to the known helical grooves.

In a further development of the invention, provision is made for the main body to be substantially cylindrical in such a way that it advantageously has at least one frusto-conically tapered end whereby the make-up application is facilitated in the peripheral regions.

The spacing between two adjacent grooves may be 0.2 mm to 1.0 mm, especially 0.64 mm.

Distributed along the length of the applicator there may be 5 to 580 grooves.

The applicator preferably consists of a chromium-nickel alloy.

If the ridges or grooves are designed rounded, the curvature radius is between 0.05 and 0.3 mm.

The main body may have a longitudinal bore, which may be filled with a lighter-weight material, e.g., a plastic material, in order to thus achieve a weight saving.

The main body may have a connecting section for connection to a rod, said connecting section being pentagonal in cross section at least in sections. If this pentagonal section is overlapped by a sleeve section of the rod, and a heated or unheated stamping tool impinges upon it perpendicular to the longitudinal axis, this ensures that the stamping tool will always encounter a nearly perpendicular opposite surface, so that a reliable connection can be created.

The invention will be explained in more detail below based on a preferred example embodiment in conjunction with the drawing.

DESCRIPTION OF THE PREFERRED EMBODIMENT

Figure 1:
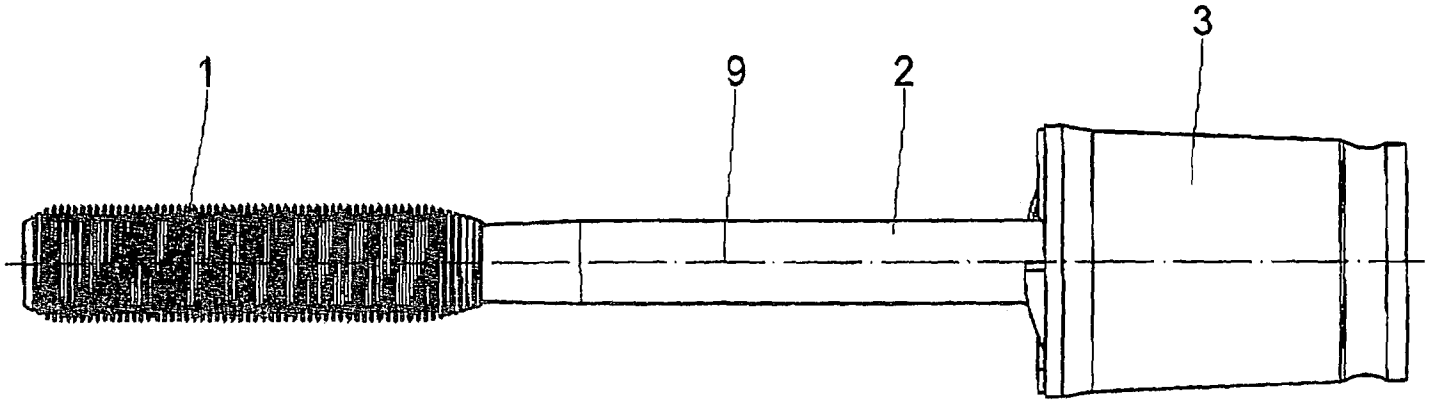
FIG. 1 shows a side view of an inventive applicator with a rod.

An applicator 1 shown in the drawing is connected to a rod 2, which in turn is fastened to a closing cap 3, which serves to close reservoir and at the same time as a handle. The rod 2 may be provided with a thread for screwing onto a container.

Figure 2:
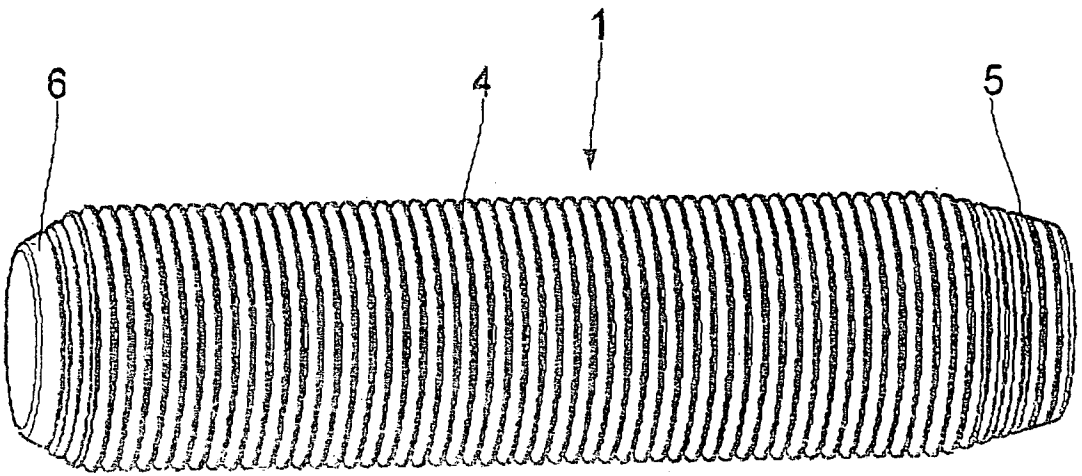
FIG. 2 shows an enlarged perspective view of the applicator.
Figure 3:
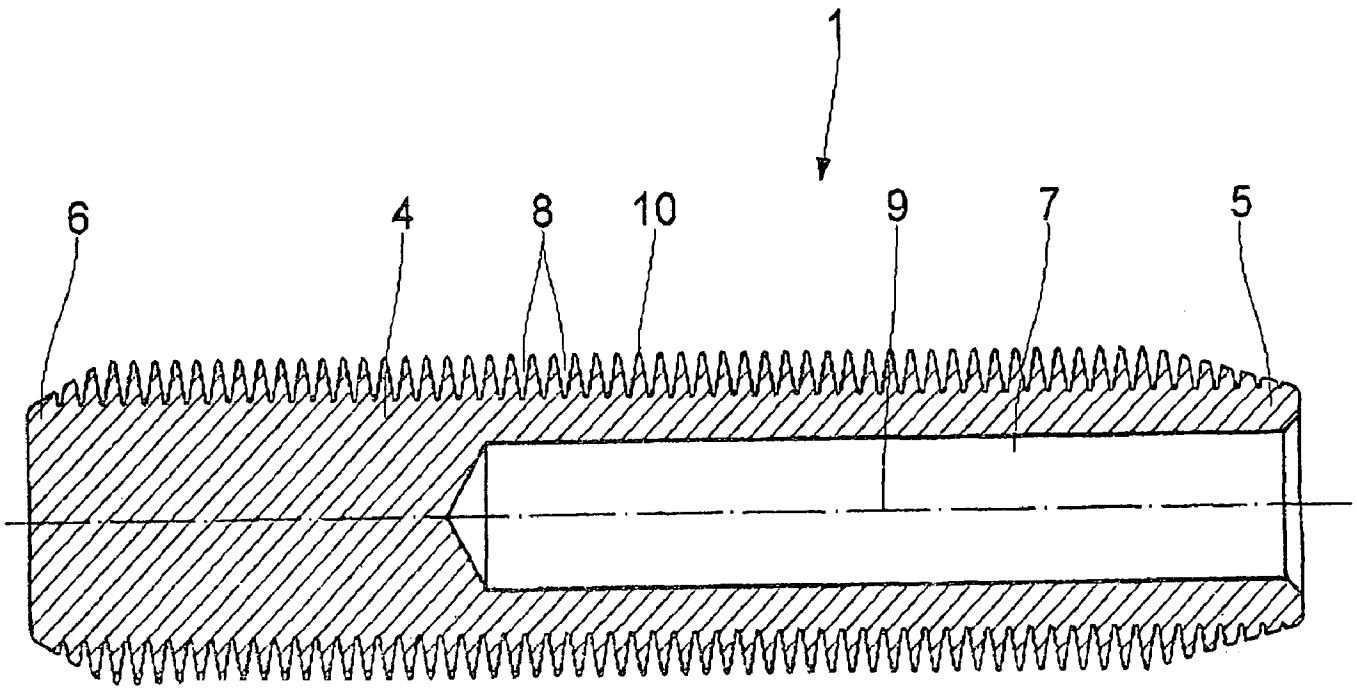
FIG. 3 shows a further enlarged longitudinal section of the applicator.

It is apparent especially from FIGS. 2 and 3 that the applicator 1 has a substantially cylindrical main body 4 with two frusto-conically tapered ends 5 and 6. In the region of the end 5 a recess 7 is provided for affixing a rod.

The main body is provided with a plurality of grooves 8 each of which lie in a plane that extend parallel to each other and perpendicular to the longitudinal axis 9 of the main body 4.

In accordance with the preferred example embodiment, the depth of the grooves is 0.8 mm. The bottom of the grooves 8 and the corresponding ridge 10 between two adjacent grooves are formed rounded.

In addition to or in deviation from the above-described example embodiment, the following embodiment characteristics may be provided as well.

The grooves 8 may be designed wholly or partially V-shaped or U-shaped in cross section wherein each is formed by two annular smooth planar surfaces as shown in FIG. 3.

The applicator may be coated with a transparent or colored lacquer. This coating prevents oxidation.

The envelope of the applicator body may be curved cylindrically, cylindrical-conically, conically, concavely, or convexly.

The applicator may have a wiper arrangement associated with it, which may be composed of rubber or of a highly elastic plastic material, and whose wiper ring has a diameter between 2 and 8 mm and leaky optionally be discontinuous.

The applicator may have at least one slot, viewed in the longitudinal direction. The at least one slot may extend parallel or helical relative to the longitudinal axis of the applicator. Multiple slots, up to 18, may optionally be provided.

The applicator may be composed of a light metal, especial aluminum.

What is claimed is:

1. A mascara applicator comprising a main body of metal for applying mascara to an eyelash, said main body comprising a first frusto-conical end section, a cylindrical middle section, and a second frusto-conical end section, said first frusto-conical end section having a recess defined therein, said recess extending only part-way through the main body, said main body being connectable to a rod and having a plurality of circumferential grooves defined therein, said rod being inserted into said recess, said plurality of grooves extending entirely over said first frusto-conical end section and said cylindrical middle section, and only partway over said second frusto-conical end section, so as to leave a portion of said second frusto-conical end section without any grooves, each groove of said plurality of grooves lying in a plane that extends parallel to each other and substantially perpendicular to a longitudinal axis of the main body, wherein each of the grooves is V or U shaped in cross section and has two planar smooth side surfaces;

wherein the depth of the grooves is configured to transfer mascara to an eyelash and being 0.4 mm to 2.1 mm;

wherein bottom of at least one of the grooves and a ridge between two adjacent grooves is formed rounded; and wherein said plurality of grooves comprises 5 to 85 grooves.

2. An applicator according to claim 1, wherein the main body is substantially cylindrical.

3. An applicator according to claim 1, wherein the spacing between two adjacent grooves is 0.2 to 1.0 mm.

4. An applicator according to claim 3, wherein the spacing between two adjacent grooves is 0.64 mm.

5. An applicator according to claim 1, wherein the applicator is composed of a chromium-nickel alloy.

6. An applicator according to claim 1, wherein a curvature radius is between 0.05 and 0.3 mm.

7. An applicator according to claim 1, wherein the longitudinal bore is filled with a lighter-weight material.

8. An applicator according to claim 7, wherein the longitudinal bore is filled with a plastic material.

9. An applicator, especially according to claim 1, wherein the main body has a connecting section for connection to the rod, said connecting section being pentagonal in cross section at least in sections.

10. An applicator according to claim 1, wherein the depth of the grooves is approximately 0.8 mm.

* * * * *